United States Patent [19]

Yang

[11] Patent Number: 4,828,241

[45] Date of Patent: May 9, 1989

[54] ARTICULATED C-TYPE CLAMPING ASSEMBLY WHICH IS ADJUSTABLE IN LENGTH

[76] Inventor: Tai-Her Yang, 5-1 Taipin St., Si-Hu Town, Dzan-Hwa, Taiwan

[21] Appl. No.: 31,925

[22] Filed: Mar. 30, 1987

[51] Int. Cl.[4] ..... B25B 5/14

[52] U.S. Cl. ..... 269/114; 269/45; 269/249; 269/287; 269/266

[58] Field of Search ..... 269/249, 287, 45, 43, 269/266, 104, 111, 118, 119, 113, 114, 219

[56] References Cited

U.S. PATENT DOCUMENTS

| | | | |
|---|---|---|---|
| 2,251,815 | 8/1941 | Abbratozzato | 269/249 |
| 3,423,082 | 1/1969 | Reyner | 269/111 |
| 4,322,064 | 3/1982 | Jarvis | 269/43 |
| 4,373,980 | 2/1983 | Skolmierski et al. | 269/287 |

FOREIGN PATENT DOCUMENTS

| | | | |
|---|---|---|---|
| 937259 | 11/1973 | Canada | 269/43 |

*Primary Examiner*—Robert C. Watson

*Attorney, Agent, or Firm*—Leonard Bloom

[57] ABSTRACT

This is an improvement on a C-type clamp. Its features are: on one end or both ends of a clamp body that has (1) multiple directioned connecting threaded holes; (2) attach many threaded bars that will be used to clamp a small cubic object which has several different surfaces; (3) a middle connecting bar that has several threaded bars can be jointed to two ends of a C-type clamp body which may expand outward or expand inward, enabling to clamp far aparted supporting points or to clamp object that has variety of crooked clamping points.

One step forward, both ends of a C-type clamp body has position adjustable receiving bars in a zigzag shape and one or several threaded bars can be inserted into it; or on one end or both two ends of a C-type clamp, several connecting bars are jointed together in a terrace shape which can be expanded like a fan and adjust the position of each connecting bar. These several threaded bars can clamp several points on the different vertical surfaces of a circle.

2 Claims, 17 Drawing Sheets

ARTICULATED C-TYPE CLAMPING ASSEMBLY WHICH IS ADJUSTABLE IN LENGTH

BACKGROUND OF THE INVENTION

A C-type clamp is a clamping structure consisting of a threaded bar inserted on one end and a holding receptacle on the other end. While working on a soft material, usually a small cubic object, it always has several different flat surfaces that need clamping. The affixing process is needed for gluing a bending shaped object or a wide surface plate such as a wooden plate or working on a wooden product.

A traditional C-type clamp with a single threaded bar cannot meet these variety of work. Annoyance happens. In another word, a clamping distance of a traditional C-type clamp is limited. A sole holding receptacle cannot clamp and press effectively the object that has meandered small surfaces.

SUMMARY OF THE INVENTION

This invention supplies an improved C-type clamp. On the one end or both ends, there are several threaded bars in a close parallel position which can make an independent driving and clamp upon a soft, small working object. It supplies middle connecting bars. Each bar has threaded bars on it. Connection of middle connecting bars enable to lengthen clamping distance, expand as a fan to clamp various soft working object such as clamping wooden product, plastic material for processing.

BRIEF DESCRIPTION OF THE INVENTION

FIG. 1. A solid view of a C-type clamp of this invention with a complete C-type clamp body that has connecting holes.

FIG. 2. A front view of a C-type clamp that has connecting holes.

FIG. 3. A solid view of a C-type clamp of this invention that has vertical and horizontal connecting holes.

FIG. 4. A front view of a C-type clamp that has vertical and horizontal connecting holes.

FIG. 5. A side view of FIG. 4.

FIG. 6. A solid view of a half sectioned C-type clamp body of this invention.

FIG. 7. A front view of a half sectioned C-type clamp body of this invention.

FIG. 8. A solid view of a half sectioned C-type clamp body that has vertical and horizontal connecting holes for this invention.

FIG. 9. A front view of a half sectioned C-type clamp body of this invention.

FIG. 10. A front view of a middle connecting part of this invention.

FIG. 11. A solid view of an extending structure for a C-type clamp that has position adjustable clamp and stabilizing slide clamp of this invention.

FIG. 12. A front view of an extending structure of a C-type clamp of this invention.

FIG. 13. A solid view of a C-type clamp body that has several threaded bars for this invention.

FIG. 14. An implementation example of a C-type clamp body of this invention that has several sets of threaded bars.

FIG. 15. An implementation example of a C-type clamp body of this invention that has several sets of threaded bars.

FIG. 16. A front view of a closed method, extended clamp of this invention.

FIG. 17. A solid view of an implementation example of FIG. 16.

FIG. 18. A front view of an open method, extended clamp of this invention.

FIG. 19. A solid view of an implementation example of an open method, extended clamp of this invention.

FIG. 20. An implementation example of a closed method, extended clamp used to clamp a working object.

FIG. 21. An implementation example f an open method, extended clamp used to clamp a working object.

FIG. 22. A solid view of a C-type clamp body which has several receiving bars on both ends of the straight bar for this invention.

FIG. 23. A solid view of multiple connecting bars that can swing out on both ends of a C-type clamp body straight bar for this invention.

FIG. 24. An up view of an implementation example of this invention for several connecting bars linked together.

FIG. 25. A solid view of an implementation example of several connecting bar clamps of this invention.

FIG. 26. A solid disassembled view of one end of several connecting bar clamps in an implementation example of this invention.

FIG. 27. A sectional view of one end of multiple connecting bar clamps in another implementation example of this invention.

DETAILED DESCRIPTION OF THE INVENTION

Figure 1:
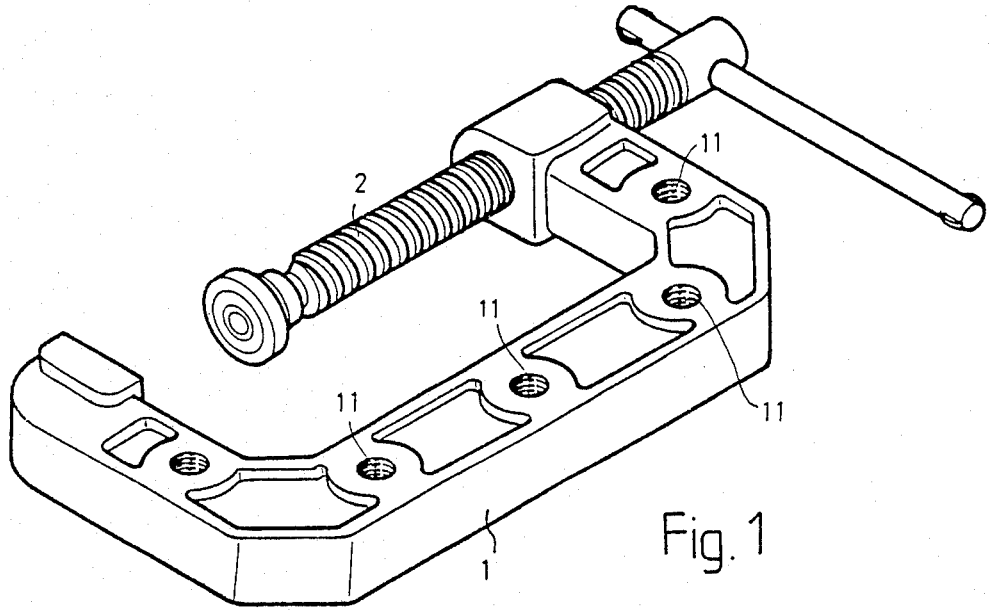
Figure 2:
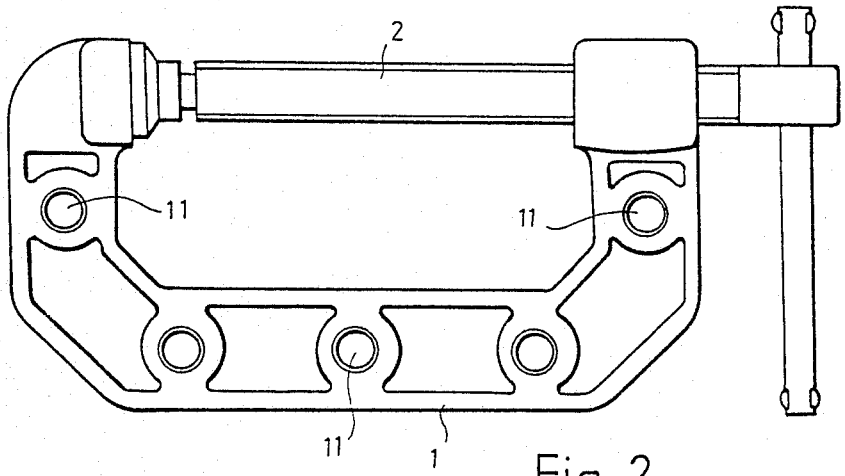

The C-type clamp structure design as shown in FIG. 1 and FIG. 2, several horizontal connecting holes 11 may be made on a complete C-type clamp body 1 which can be connected with other middle connecting part such as a connecting bar or a bending bar by screwing into the thread. It is used to extend and connect other equipment or similar, various clamps or to fix the position.

To reduce the weight of a clamp and decrease material used in manufacturing a clamp, the areas between each two connecting holes 11 may be indented inward.

Figure 3:
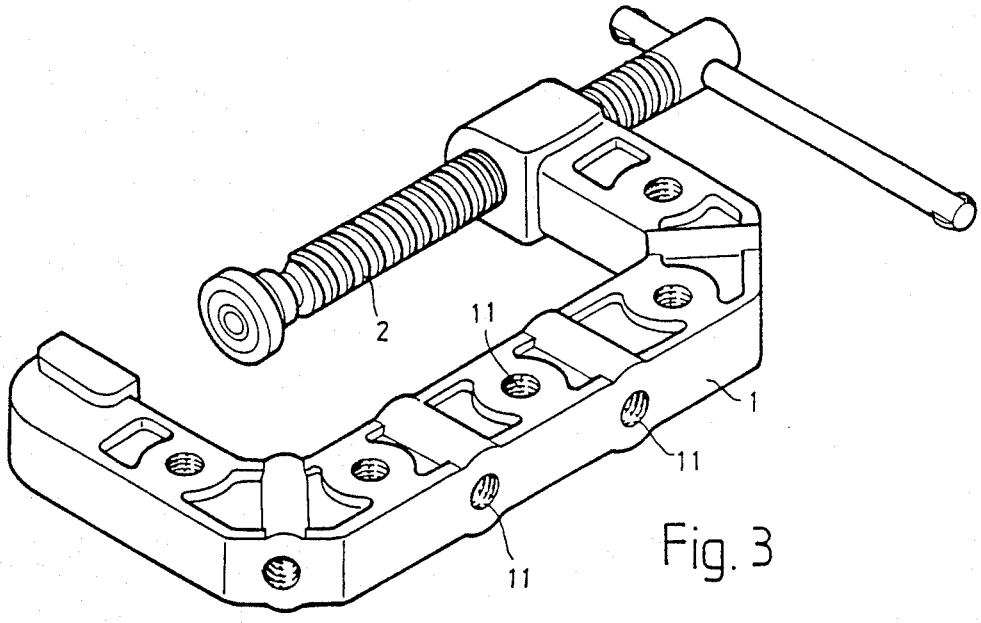
Figure 4:
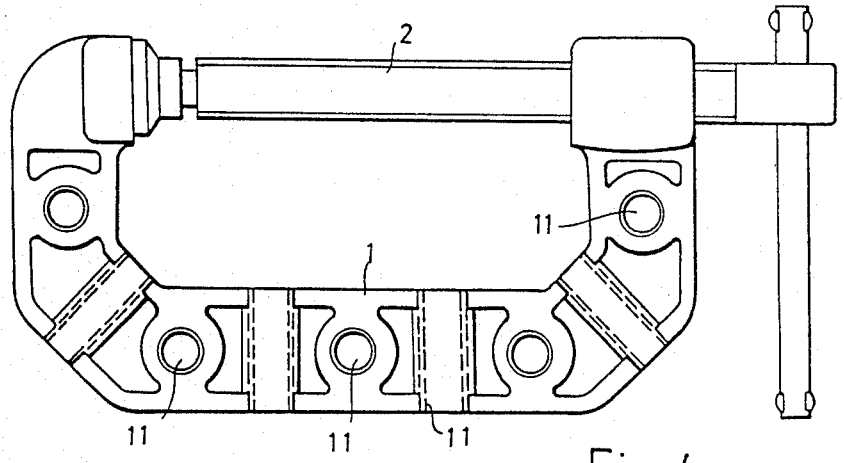
Figure 5:
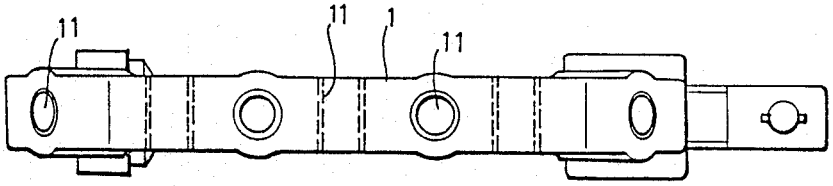
Figure 6:
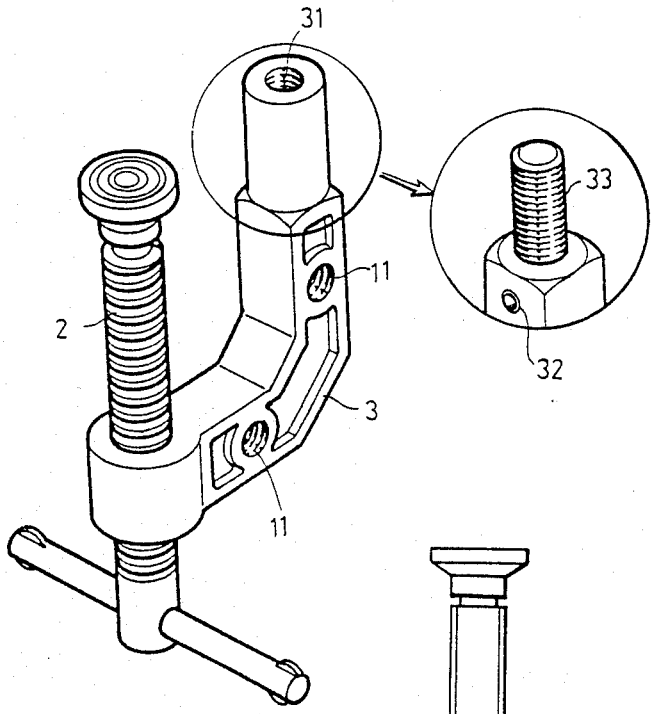
Figure 7:
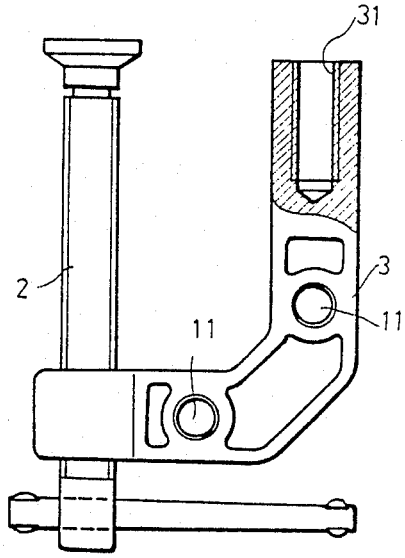
Figure 8:
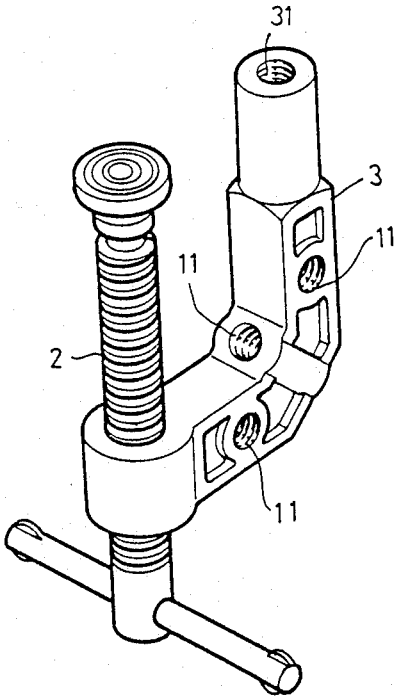
Figure 9:
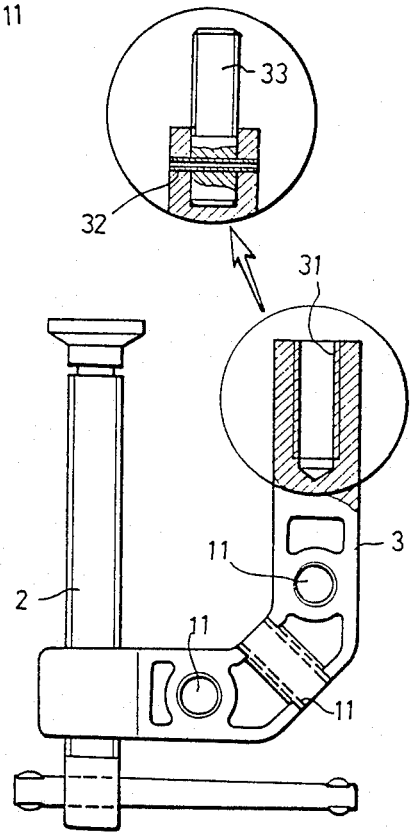

As shown in FIGS. 3, 4 and 5, there are several vertical and horizontal connecting holes 11 on a complete C-type clamp body 1.

On the sides of a clamp body where excavating is possible, make an indented structure. The hole allows to be connected with middle connecting parts in parallel in order to make a horizontal expansion. It allows to be linked vertically, back to back, in order to widen. Thus, a C-type clamp may expand in many directions and enlarge the number of clamping point for a big working object.

Shown in FIGS. 6, 7, 8 and 9 is a half sectioned C-type clamp body 3 and a threaded bar 2. There are horizontal or vertical connecting holes 11, or both horizontal and vertical connecting holes at the same time on a half sectioned C-type clamp body 3. Also there are indented areas. The cut off end of a clamp body may have a round bar shape and a threaded hole 31 in its center. A horizontal opening 32 may made near the end to put a roll pin into it for connecting a combining threaded bar 33. By doing this, the threaded hole 31 can be turned into a threaded bar, enabling it to be screwed into a middle connecting bar that has a threaded hole, or directly screw to a C-type clamp body 1 of another C-type clamp.

Figure 10:
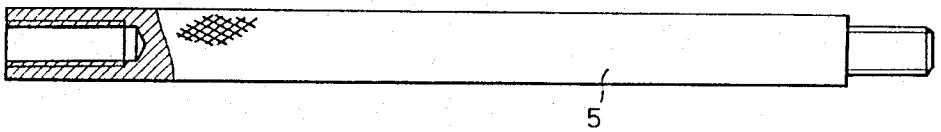

As shown in FIG. 10, both ends of a middle connecting part may be directly screwed to a C-shaped clamp body of a C-type clamp or a connecting hole 11 of a half sectioned C-shape clamp body 3. It also can convert to a threaded hole into a threaded bar by adding a threaded bar to connect other unit or screw it to a C-type clamp body.

Figure 12:
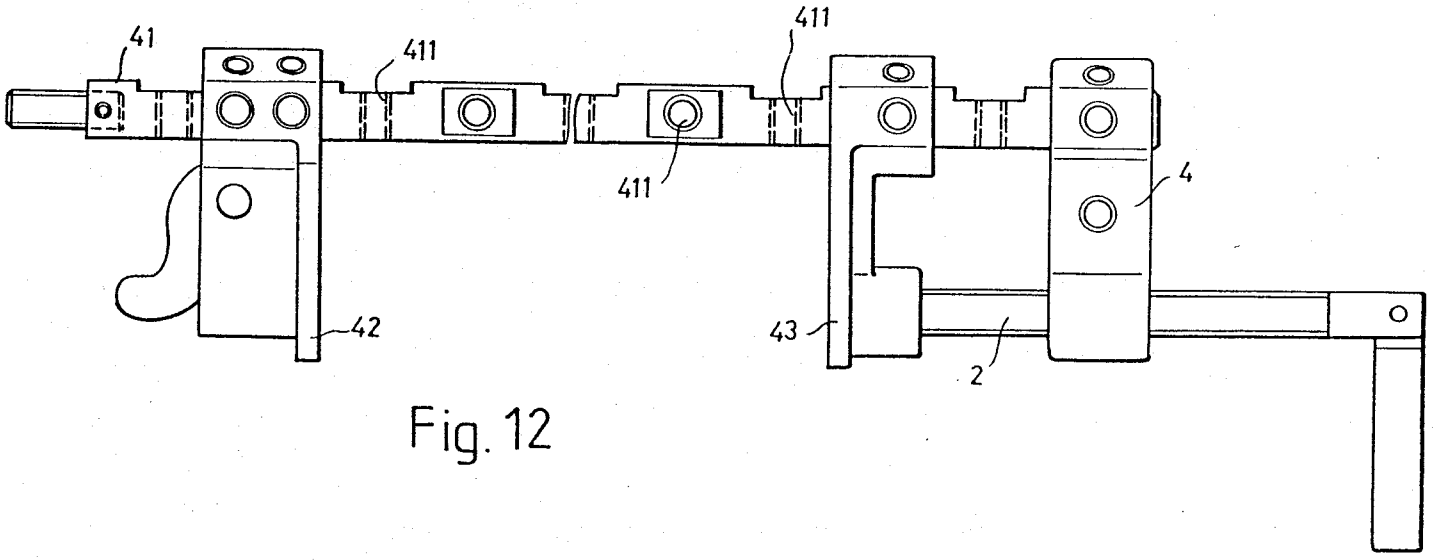
Figure 11:
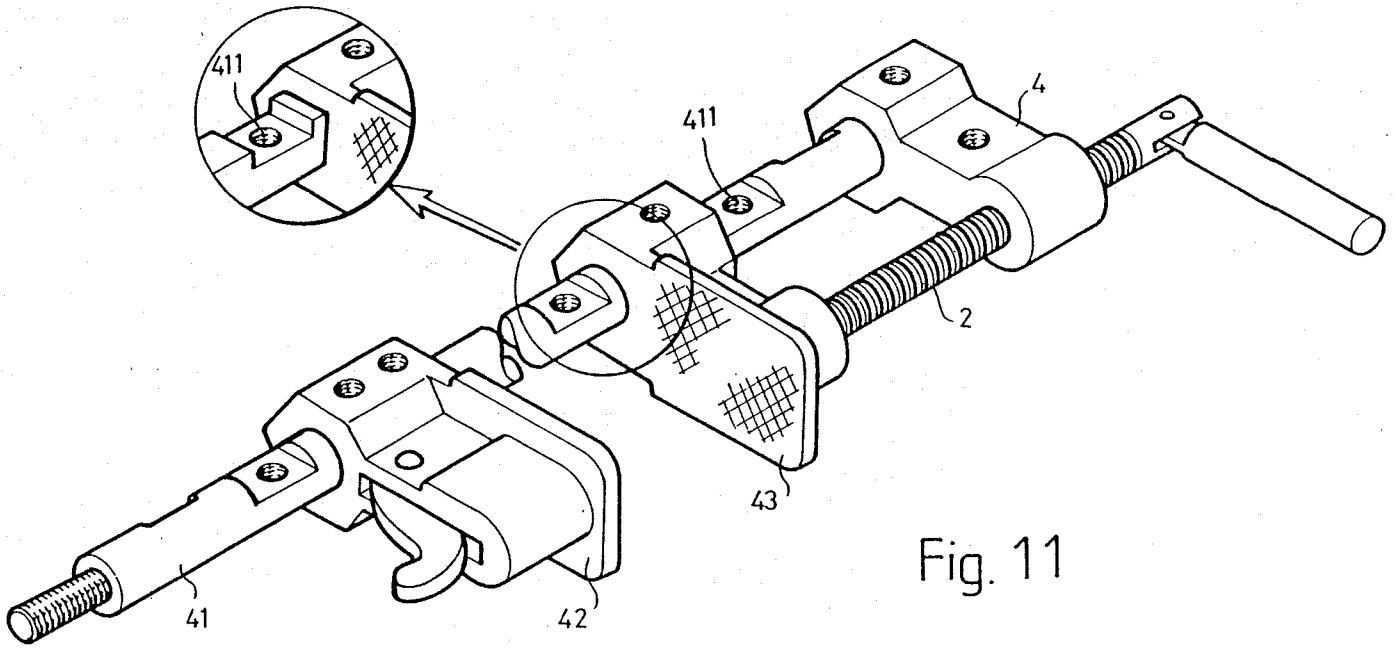

The structure of a C-type clamp with one threaded bar 2, one step ahead, may be made as shown in FIGS. 11 and 12. Two parallel, piercing holes are made on both ends of a fixing base 4. A threaded bar 2 is screwed into one hole. A guiding bar 41 is screwed firmly to the other hole. This guiding bar 41 is extending a certain length in the advancing direction of a threaded bar 2. Its end is threaded. A guiding bar 41 may be a round bar or a square bar. There are several, multiple direction connecting holes 411 on this bar. In case of a round bar, cut flat a small section and drill a connecting hole 411. On the bar body of this guiding bar 41, a position fixing clamp base 42 and a sliding clamp base 43 are installed. On the opposite side of the holding face of a position fixing clamp base 42, a tightening equipment is installed, which is intended to hook or release a position fixing base 42. It allows to make a sliding adjustment to correspond the length variation of supporting points of a working object.

The tightening equipment enables a position fixing base 42 to grasp tightly on a guiding bar 41.

A guiding bar 41 is a sliding rail for a sliding clamp base 43. A sliding clamp base is directly driven by a threaded bar 2. It performs a pressing and clamping function with a position fixing clamp base 42 that facing it.

On the circumferences of a fixing base 4, a position fixing base 42 and a sliding clamp base 43 that embracing a guiding bar 41, and on a guiding bar 41, there are connecting holes 411 to be used to joint and connect other set of clamp or middle connecting part.

The width (length) of a cut flat part of a guiding bar 41 which is round column shaped must be smaller than a position fixing clamp base 42 and a sliding clamp base 43 by a half width.

Figure 13:
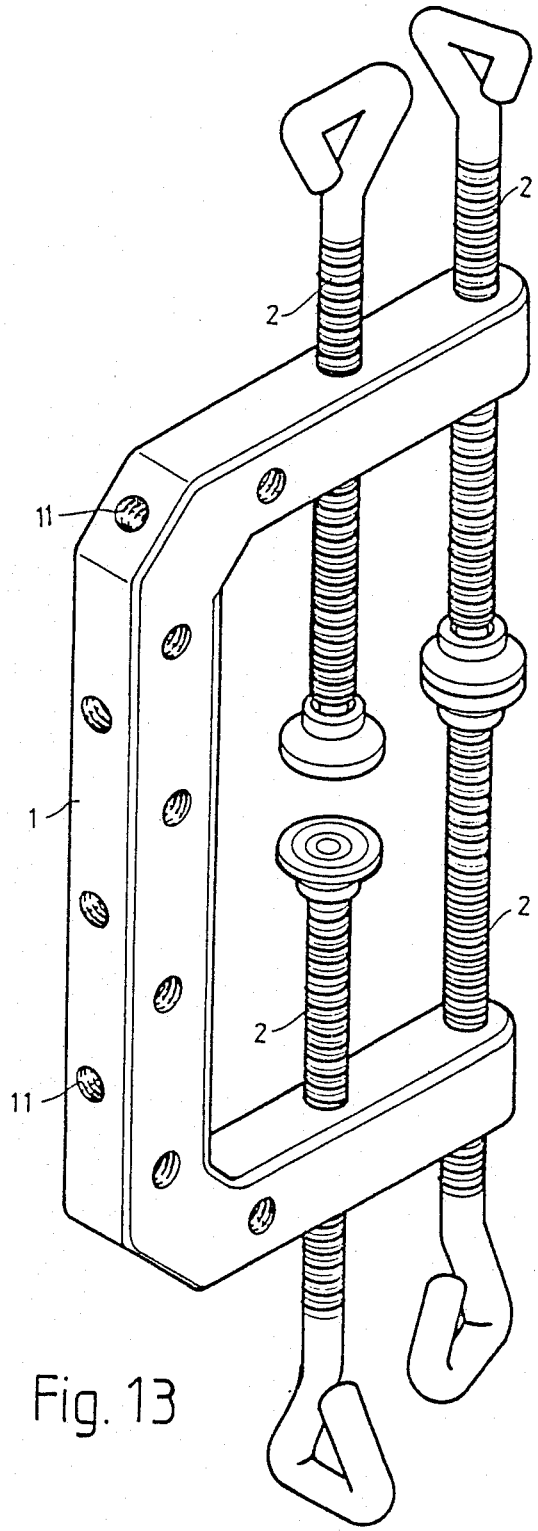

As shown in FIG. 13, on both of the flatly bended parts of a complete C-type clamp body 1, two threaded bars 2 are screwed into each part. The neighboring threaded bars 2 are independently driven. They may be screwed separately and clamp on different surfaces at different time.

Figure 14:
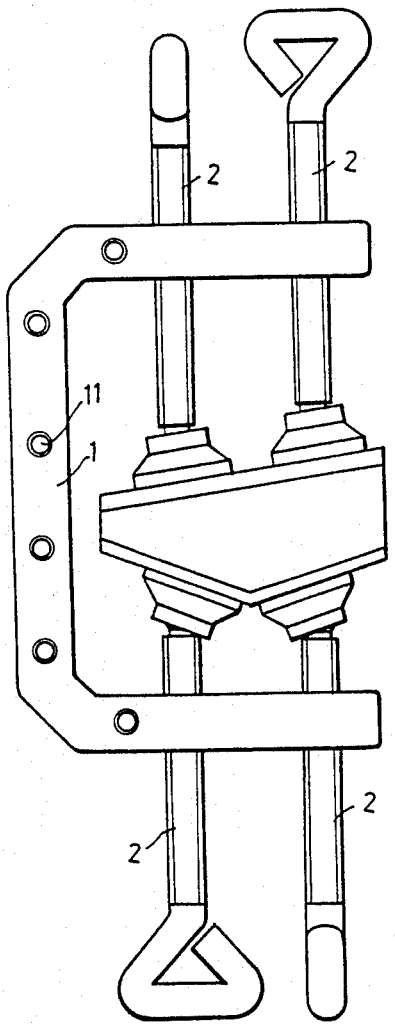
Figure 15:
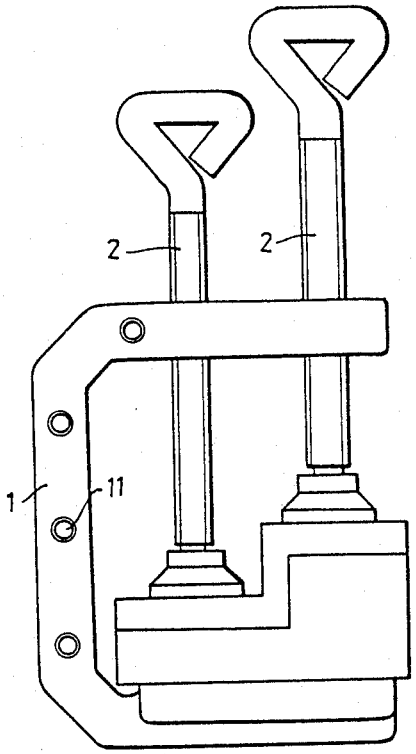

As shown in FIG. 14 and FIG. 15, while in practical operation, two clamps clamp and press on four clamping points that are not on the same flat surface or not on a paralleled surfaces. Two threaded bars 2 on one end of a clamp may clamp on the surfaces that are not on the same level or on one side of unparalleled surfaces.

On the C-type clamp body 1 of this design, there are many multiple direction holes 11 used to connect with other clamp or middle connecting part for extension and expansion.

On both of the flatly bended parts of a C-type clamp body 1 of this invention, a proper mechanical joint structure may connect several extending bars 12. One or two threaded bars 2 are installed on each extending bar 12. It allows to extend and enlarge the length or depth of clamping points.

Figure 16:
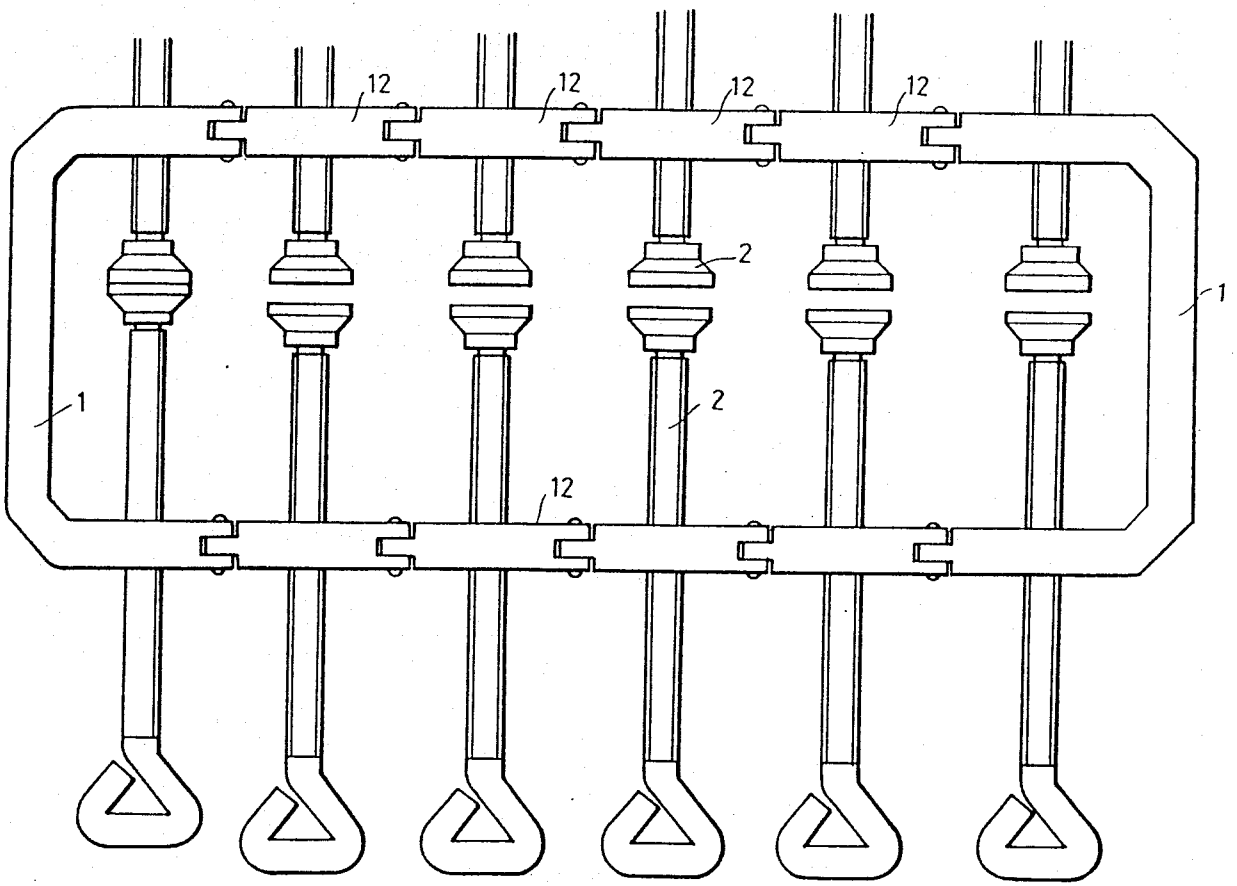
Figure 17:
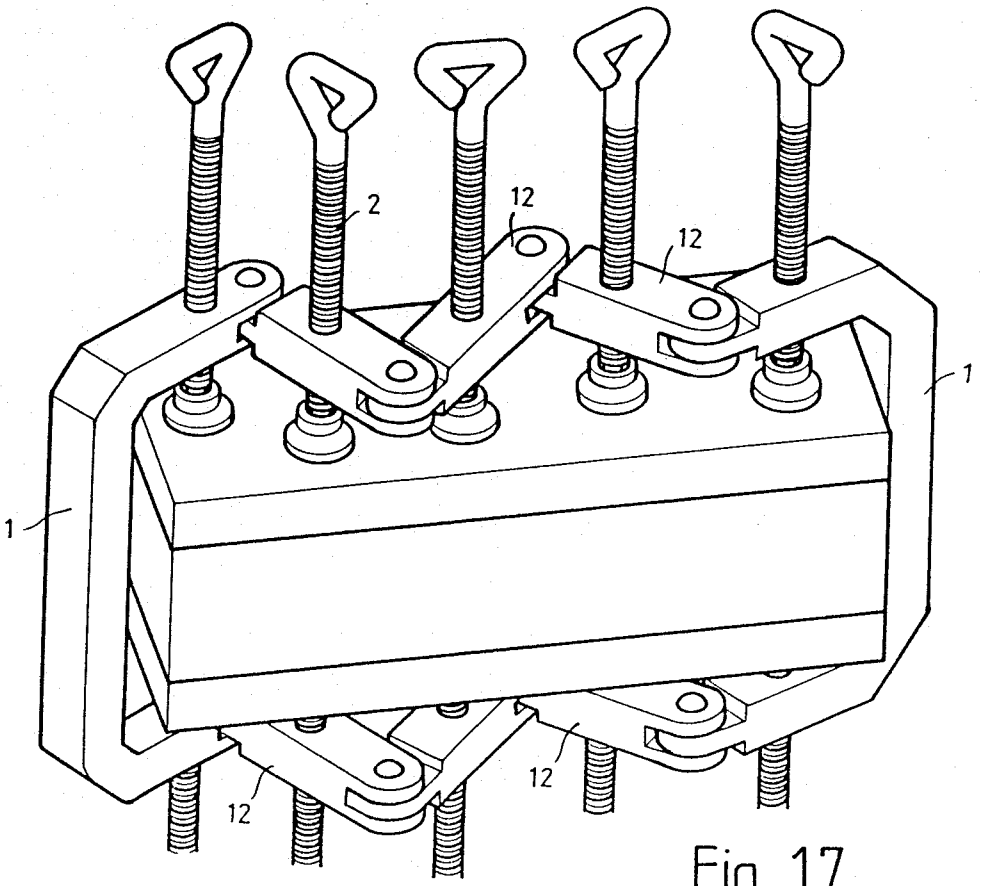

As shown in FIG. 16 and FIG. 17, between two complete C-type clamp bodies 1, several extending bars 12 which are in the same length or not in the same length, are jointed together to become a closed clamp. Between two neighboring extending bars 12 or the extending bar with C-type clamp body 1, they are flexible to each other in a large degree. It enables to make a contraction and expansion and is suited to have a proper working field.

One step forward, on both ends of a C-type clamp body 1, several extension bars 12 are connected for the purpose of expanding the length. On the last set of the upper and lower extension bars 12, the last end clamp 13 may be used to hook them. It may release too.

Figure 18:
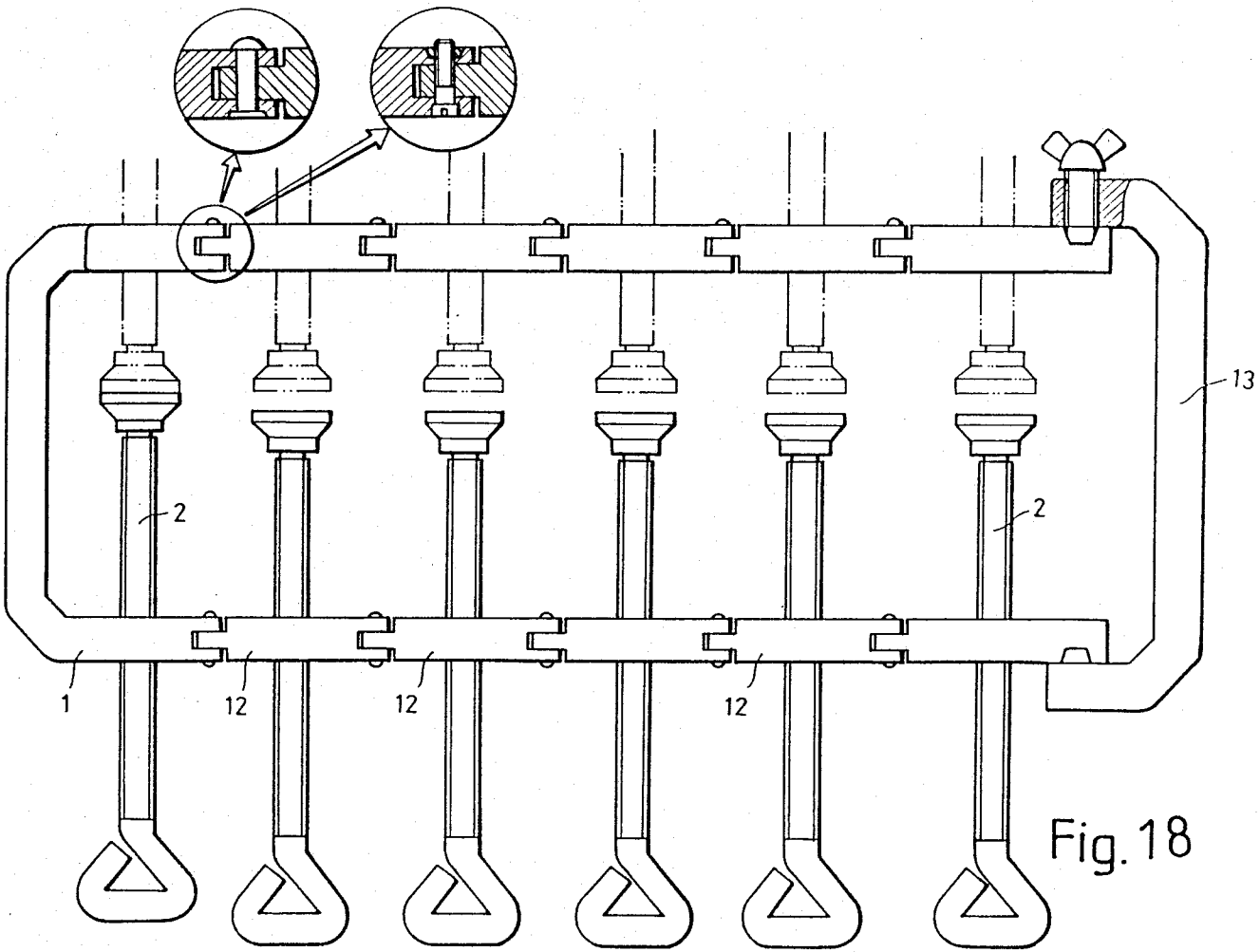

As shown in FIG. 18, the connection between C-type clamp body 1 and an extension bar 12 or between two extension bars 12, may be made by rivet or by using a flat head bolt and a nut that can sink under.

Figure 19:
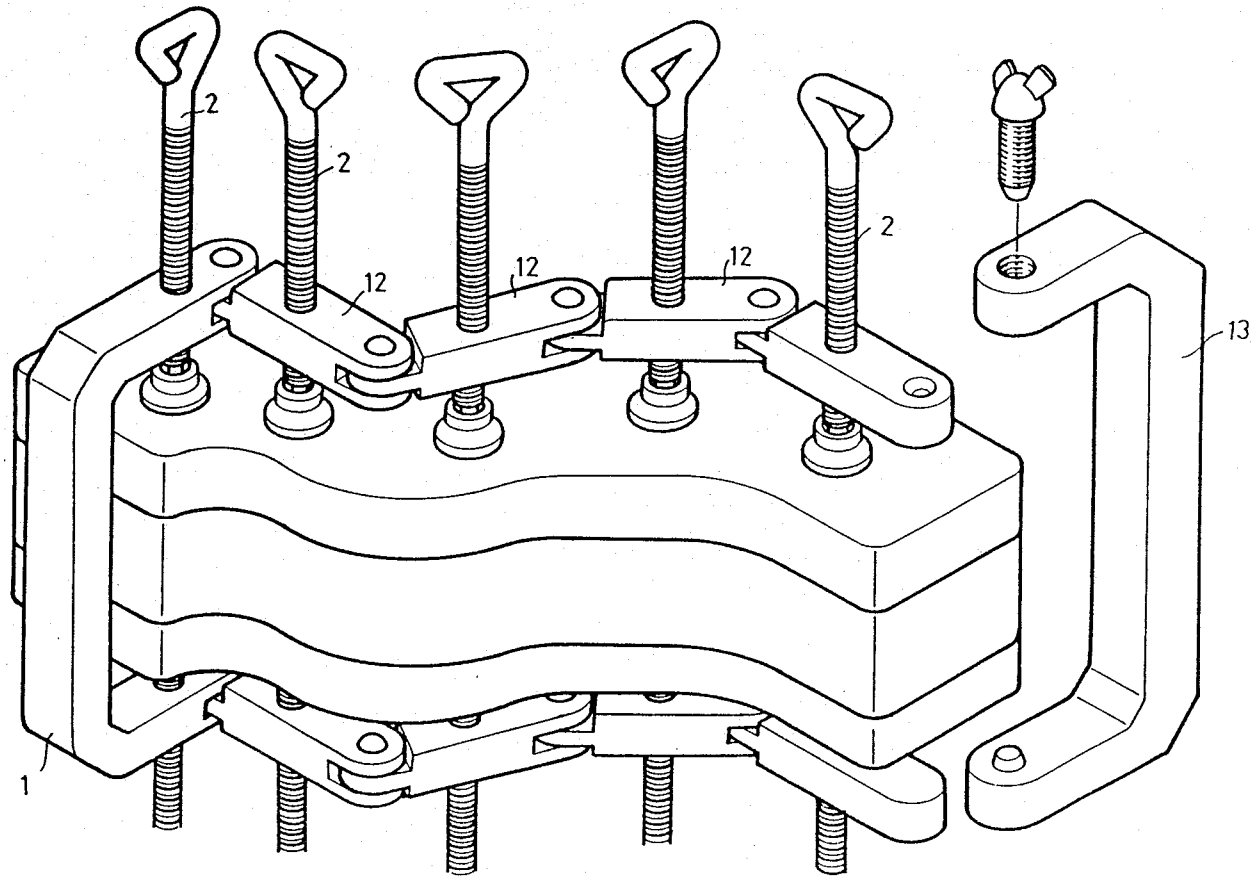

The last end clamp 13 snaps on two extension bars 12 by a cone column on the flatly bended part. Thus it creates a closed clamp or an open clamp. The number of extension bars 12 can be changed by adding or reducing. It allows to change clamping length as shown in FIG. 19.

In the clamp structure design as stated above, its last end clamp 13 may extend and enlarge clamping depth.

Figure 21:
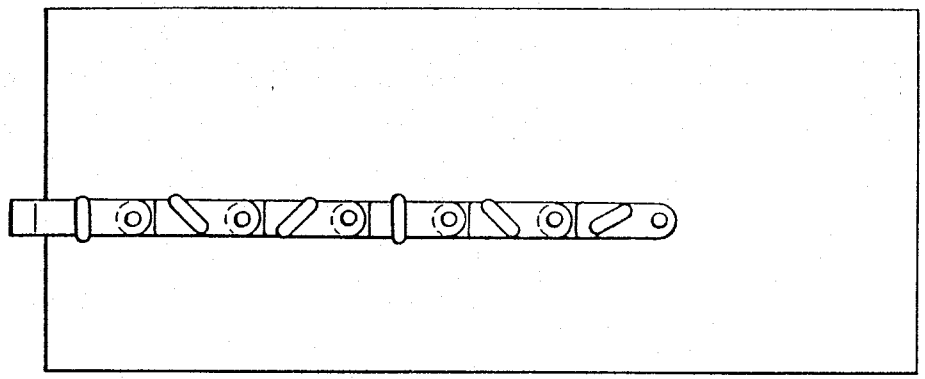
Figure 20:
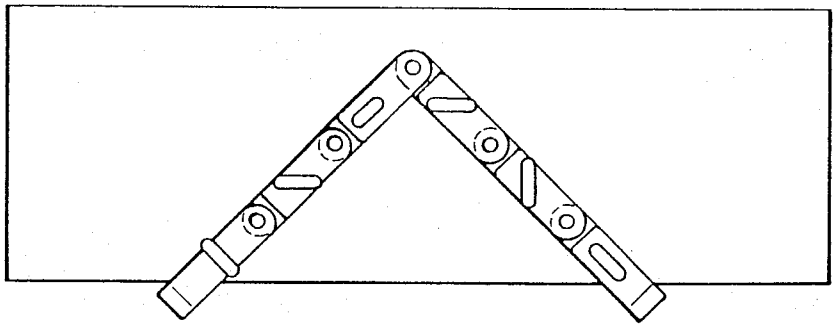

By releasing the last end clamp 13, it transforms into an open type clamp that can make a deep clamp in its full length. The clamping depth is shallower for a closed type clamp as shown in FIG. 20 and FIG. 21.

Figure 22:
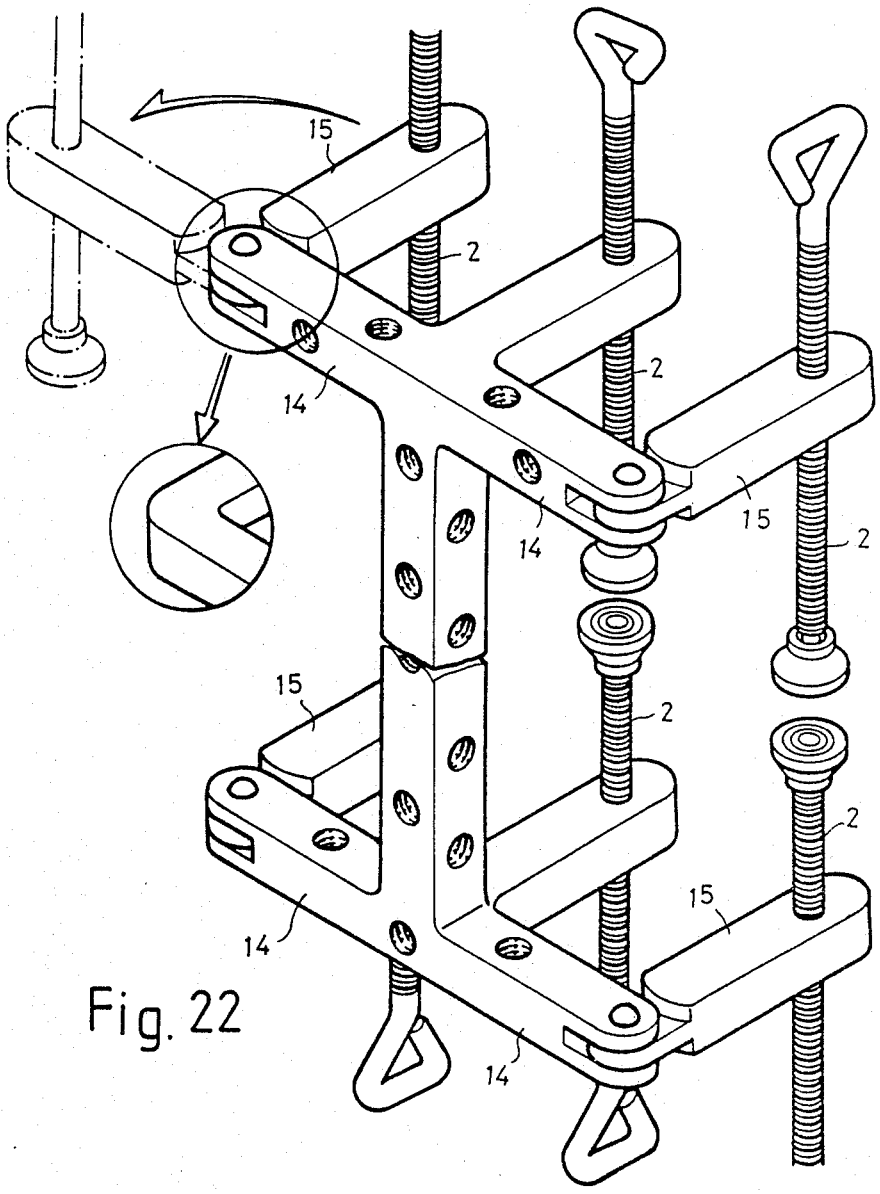

As shown in FIG. 22, the flatly bended root parts of a C-type clamp, one step ahead, may have flank extension bars 14 extending from two sides outward.

The end of a flank extension bar 14 may turn again to be an accepting bar 15 which is in parallel and in the same height to the flatly bended part of a C-type clamp.

This accepting bar 15, one step forward, may be jointed to a flank extension bar 14 allowing to swing or lock firmly.

On each accepting bar 15, there are one or two threaded bar 2 enabling to make deeper and wider clamp or large arc shaped clamp.

The above stated design, one step ahead, on one end or both ends of a straight part of a C-type clamp body 1, several connecting bars 16 may be attached in a stair step position.

They may expand in a fan shape. The position of each connecting bar 16 is adjustable.

Figure 23:
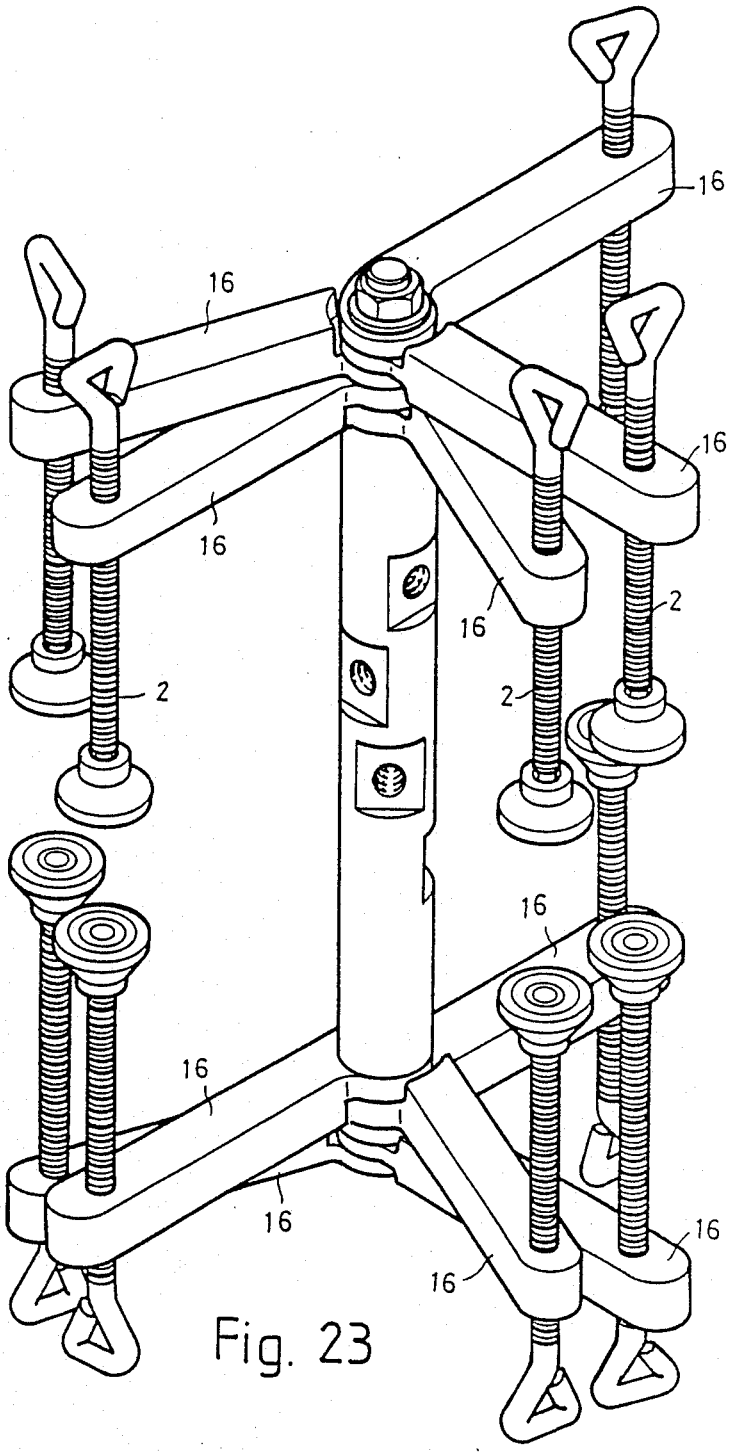
Figure 24:
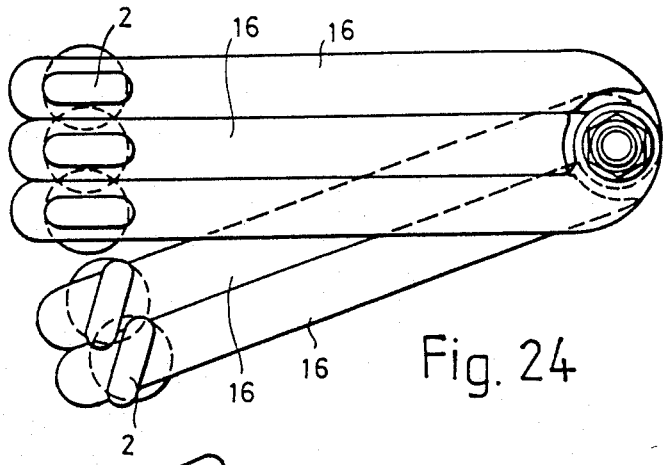

As shown in FIG. 23 and FIG. 24, each step may consist of two to four connecting bars 16. They are linked by their flanges and mounted on the straight part of a C-type clamp body 1 and are locked by a nut.

Each connecting bar 16 has threaded bars 2 on its both ends, or a threaded bar 2 on one end and the other end does not have it.

Figure 25:
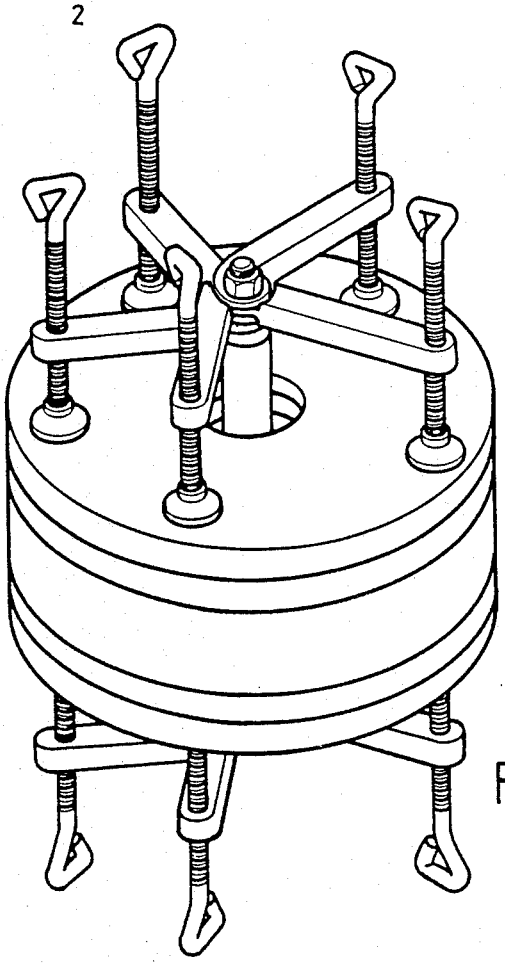

This invention may be applied to clamp an annular shaped working object as shown in FIG. 25.

Especially, when the central hole of an annular object is small and its diameter is large, if clamping points are on the outer annular rim, many traditional C-type clamps must be used one by one from outside to clamp it.

With this invention, after inserting one end of a clamp which is not assembled with connecting bars 16 into the center, then assemble connecting bars 16 and adjust the position of each connecting bar 16. Finally, turn the threaded bars 2 tightly on the surface.

Figure 26:
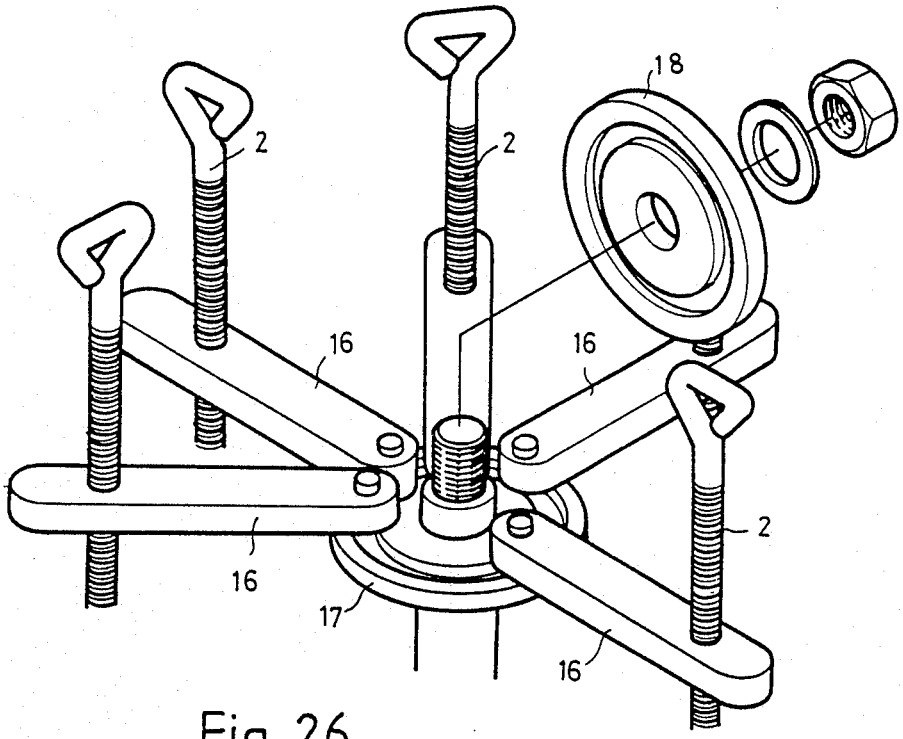
Figure 27:
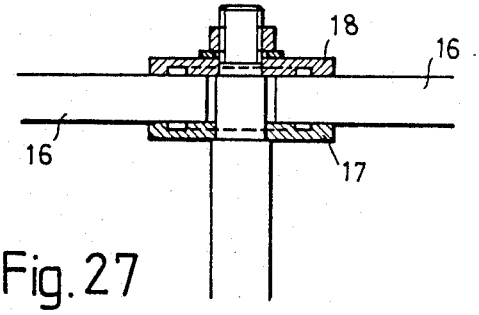

As shown in FIG. 26 and FIG. 27, one step ahead, on the end of the straight bar of a C-type clamp, attach an upper and lower discs 17, 18. Annular grooves are made on the discs.

On the top end of each connecting bar 16, insert a guide column which will be snapped and slides inside of the annular groove. It is hold and fixed by the upper and lower discs 17, 18. It can slide within the groove and change the position of a connecting bar 16.

The improvement on a C-type clamp of this invention is intended for a general soft material, various sized and shaped working object.

It is especially designed for clamping two points that are not on the same surface and two neighboring supporting points are very closely located. It is also designed for the situation that needs to clamp several clamping points, long (deep) clamping points on a surface, zigzag shaped clamping points, arc shaped or annular shaped body.

At the same time, on a C-type clamp body 1, many multiple directioned connecting holes 11 are made which are used to joint or connect other clamp or middle connecting bar. It extends and enlarges the clamping points.

What is claimed is:

1. An articulated clamping assembly which is adjustable in the length of its sides, comprising respective first and second sides comprised of first and second side sections extending lengthwise of the assembly opposite one another respectively, each side section having outermost end portions including respective first and second end portions, a first end member connecting the respective first end portions of the first and second side sections together and substantially perpendicularly thereof, a second end member connecting the respective second end portions of the first and second side sections together and substantially perpendicularly thereof, thereby forming a frame for the clamping assembly, each side section including a plurality of legs pivotably connected to each other, such that the overall assembly may be extended lengthwise to its full side length or partially collapsed upon itself so as to reduce the overall side length thereof, and a threaded clamping rod carried by each of the legs, such that the respective clamping rods on the first side section of the clamping assembly are substantially aligned with the respective clamping rods on the second side section of the clamping assembly, thereby forming respective pairs of opposing threaded rods, whereby a workpiece may be clamped between the respective pairs of clamping rods and within the frame of the clamping assembly without said side sections coming into contact with the workpiece.

2. An articulated clamping assembly which is adjustable in the length of its sides comprising respective first and second sides comprised of first and second side sections extending lengthwise of the assembly and opposing one another respectively, each side section having outermost end portions including respective first and second end portions, a first end member connecting the respective first end portions of the first and second side sections together and substantially perpendicularly thereof, a second end member connecting the respective second end portions of the first and second side sections together and substantially perpendicularly thereof, thereby forming a frame for the clamping assembly, each side section including a plurality of legs connected to each other by pivots being substantially parallel to said end members, whereby said side sections are moved around said pivots in a plane parallel to a clamped workpiece and whereby the overall assembly may be extended lengthwise to its full side length or partially collapsed upon itself so as to reduce the overall side length thereof, and a threaded clamping rod carried by each of the legs, such that the respective clamping rods on the first side section of the clamping assembly are substantially aligned with the respective clamping rods on the second side section of the clamping assembly, thereby forming respective pairs of opposing threaded rods, whereby a workpiece may be clamped between the respective pairs of clamping rods and within the frame of the clamping assembly without said side sections coming into contact with the workpiece.

* * * * *